US006971210B2

(12) United States Patent
Kliegle et al.

(10) Patent No.: US 6,971,210 B2
(45) Date of Patent: Dec. 6, 2005

(54) ACCESSIBLE CEILING GRID SYSTEM

(75) Inventors: Dennis Kliegle, Holcombe, WI (US); Harry A. Alter, Granville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 8 days.

(21) Appl. No.: 10/324,996

(22) Filed: Dec. 19, 2002

(65) Prior Publication Data

US 2004/0118068 A1 Jun. 24, 2004

(51) Int. Cl.[7] ..... E04B 9/24; E04B 9/26

(52) U.S. Cl. ..... 52/506.07; 52/506.06; 52/489.1

(58) Field of Search ..... 52/39, 489.1, 489.2, 52/506.05, 506.06, 506.07, 506.08, 506.09, 52/511, 769, 773

(56) References Cited

U.S. PATENT DOCUMENTS

| | | | | | |
|---|---|---|---|---|---|
| 2,882,558 | A | * | 4/1959 | Jacobson et al. | 52/506.09 |
| 3,013,644 | A | | 12/1961 | Smith et al. | |
| 3,312,030 | A | * | 4/1967 | Gillespie | 52/796.1 |
| 3,581,453 | A | * | 6/1971 | Jones et al. | 52/506.1 |
| 3,599,921 | A | * | 8/1971 | Cumber | 248/317 |
| 3,817,014 | A | * | 6/1974 | Jones | 52/478 |
| 3,828,507 | A | * | 8/1974 | Storer | 52/506.09 |
| 3,930,338 | A | | 1/1976 | Rood | |
| 4,064,671 | A | | 12/1977 | Sauer | |
| 4,191,352 | A | | 3/1980 | Schuplin | |
| 4,208,851 | A | | 6/1980 | Sauer | |
| 4,408,428 | A | * | 10/1983 | Brooke et al. | 52/506.07 |
| 4,438,613 | A | | 3/1984 | Hintsa et al. | |
| 4,463,537 | A | | 8/1984 | Rodriquez et al. | |
| 4,548,010 | A | | 10/1985 | Hintsa | |
| 4,619,086 | A | * | 10/1986 | Naka | 52/205 |
| 4,624,088 | A | | 11/1986 | Arent | |
| 4,912,894 | A | | 4/1990 | Platt | |
| 5,046,294 | A | * | 9/1991 | Platt | 52/506.06 |

(Continued)

FOREIGN PATENT DOCUMENTS

| | | |
|---|---|---|
| CA | 1181216 | 1/1985 |

(Continued)

*Primary Examiner*—Jonathon Szumny
(74) *Attorney, Agent, or Firm*—Inger H. Eckert; Maria C. Gasaway

(57) ABSTRACT

A grid system for torsion spring mounting of aluminum-framed panels is provided which includes a plurality of main grid beams and spacer bars. The main grid beams support a side load mounting clip formed with a slot in the side of the side load mounting clip to engage a torsion spring held by a spring retainer clip such that the panel is supported by the torsion spring. Disengagement of the torsion springs lowers the panels and permits access to the ceiling grid system above the panel members. In a preferred embodiment, the panel has a multifaceted profile including an edge surface that abuts a corresponding edge surface on an adjacent panel. The peripheral edges of the adjacent panel members diverge above the abutting edge surfaces to accommodate either the alignment fin or the tab of the tile stop and diverge below the abutting edge surfaces to form a reveal.

29 Claims, 10 Drawing Sheets

U.S. PATENT DOCUMENTS

| | | | | | |
|---|---|---|---|---|---|
| 5,218,799 | A | * | 6/1993 | Appino | 52/213 |
| 5,394,669 | A | | 3/1995 | Hallett et al. | |
| 5,428,930 | A | | 7/1995 | Bagley et al. | |
| 5,535,566 | A | | 7/1996 | Wilson et al. | |
| 5,901,522 | A | * | 5/1999 | Slater | 52/641 |
| 6,138,416 | A | | 10/2000 | Platt | |
| 6,205,732 | B1 | | 3/2001 | Rebman | |
| 6,318,042 | B1 | | 11/2001 | Bloom et al. | |
| 6,517,760 | B1 | * | 2/2003 | Lazzara | 264/219 |
| 6,720,089 | B2 | * | 4/2004 | Nemchock | 428/660 |

FOREIGN PATENT DOCUMENTS

| | | | | |
|---|---|---|---|---|
| FR | 2762630 | | | 10/1998 |
| GB | 2153407 | A | * | 8/1985 |
| GB | 2273511 | | | 6/1994 |
| JP | 2002054227 | A | * | 2/2004 |

* cited by examiner

ACCESSIBLE CEILING GRID SYSTEM

TECHNICAL FIELD AND INDUSTRIAL APPLICABILITY OF THE INVENTION

The present invention relates generally to the field of suspended ceiling systems, and more particularly a grid system for torsion spring mounting of aluminum-framed panels.

BACKGROUND OF THE INVENTION

Referring to FIGS. 1–2, a three-quarter perspective view showing a typical conventional torsion spring type suspended ceiling system is depicted. As shown in FIG. 1, grid system 1 includes a plurality of ceiling panels 2 that are supported by a grid 4. Torsion springs 12, 12*a* hold each panel 2 against a foot portion 4*a* of the support grid 4. Panel 2*a* is depicted as being in the open or partially disconnected position. In this embodiment, torsion springs 12*a* are shown in the disengaged position relative to butterfly clips 6. Torsion springs 12 of panel 2*a* are disconnected from their corresponding butterfly clips (not shown). The dangling ceiling panel 2*a* shows that each panel 2 has a metal frame 8 around its circumferential edge. Clips 10 permit the frame 8 to be connected to the torsional springs 12, 12*a*.

Referring now to FIG. 2, the relationships between the support grid 4 and the ceiling panels 2 can be seen in more detail. In FIG. 2, the support grid 4 is formed of known T-bars 250, 250*a*. Each T-bar 250, 250*a* has a foot flange 253, a web 251, and a head portion 254. Attached to the head portion 254 is a butterfly clip 230 via a releasable fastener 240, e.g., a screw. Each butterfly clip 230 includes a U-shaped channel 232 and a projecting flange 234 into which is formed a slot 236. Arms 218 of the torsional spring 214 fit into ends of the slot 236. The torsional spring 214 is shown in the disengaged position wherein retaining feet 220 of the torsional spring 214 rest against an upper surface of the projecting flange 234. A framed panel 15 has a frame 8 formed around the circumferential edge of the panel 2. The framed panel 15 can have an optional fabric cover 210. An attachment clip 212 fits over a flange of the frame 8. A hook portion of an attachment clip 212 fits into the wound portion 216 of the torsional spring 214.

As shown in FIG. 2 and discussed briefly above, the butterfly clip 230 is affixed to the head portion 254 of T-bar 250 by a releasable fastener 240, which is typically a screw. To affix the butterfly clip 230 to T-bar 250, holes (not shown) on T-bar 250 and the butterfly clip 230 are aligned. The releasable fastener 240 is then inserted into the holes. If the releasable fastener 240 is a screw, the screw must then be tightened to hold the butterfly clip 230 in its proper orientation. Aligning the holes and fastening the butterfly clip 230 to T-bar 250 (and optionally tightening the releasable fastener 240) is a time consuming process. Moreover, attaching the butterfly clip 230 to T-bar 250 (i.e., the alignment of the holes, etc.) must be conducted at the job site because shipping the T-bars 250, 250*a* installed would take up too much room and would therefore make shipping difficult.

In addition, because the butterfly clip 230 can only be installed at the location of the holes (not shown) on the T-bar 250, the springs 214 are located at a fixed location, typically near the corners of the panels 2. Moreover, T-bar 250*a* must necessarily be joined at a location between the holes (not shown) in the T-Bar 250. Because T-bar 250*s* is affixed to T-bar 250 at a predetermined position, there is no flexibility in the positioning of the conventional grid system. This is particularly disadvantageous if an obstruction (e.g., a sprinkler) is present in the ceiling.

Furthermore, in the conventional grid system, sections of the ceiling grid must be pre-assembled on the floor or other flat surface to form "ladder sections" in workable sizes. These ladder sections are then lifted to the ceiling and installed by screwing the sections together. Typically, there are at least six screws per joint that must be tightened. In fact, only the final assembly of the grid frame takes place in the ceiling. Moreover, the installer needs to carefully plan the placement of the ladder sections so that the installer can reach above the grid system to connect the ladder sections in the ceiling. Planning the placement of the ladder sections and tightening all the screws necessary to hold the grid system together are difficult and time consuming processes.

In other conventional embodiments (not shown), to fit the framed panel against the T-bars, the arms of the torsion spring have to be pushed up through slots. In particular, the spring must be compressed by hand and the arms guided up through the slots punched in the ceiling grid to achieve engagement. This requires complete visual observation and steady hands to accomplish. Once the arms of the spring are installed the slot, the frame will bear against the foot portion of T-bar. Moreover, in conventional ceiling grids, the reveal between panels is created by a rounded edge on the panel frame and center grid flange. Thus, if the panels shift to one side, there is potential for the rounded lip to hang up on itself, which causes the panel not to rest flush with the adjacent panel.

It is therefore desirable to provide a grid system for torsion spring mounting of aluminum-framed panels that overcomes the disadvantages of the prior art.

SUMMARY OF THE INVENTION

An embodiment of the present invention provides a grid system for torsion spring mounting of aluminum-framed panels that overcomes the disadvantages of the prior art.

An embodiment of the present invention that to provides a grid system for torsion spring mounting in which the torsion spring can be moved laterally relative to the cruciform grid main.

An embodiment of the present invention provides a grid system for torsion spring mounting that can be quickly and easily installed without the use of releasable fasteners.

An embodiment of the present invention provides a grid system to provide a perimeter grid for proper alignment with the wall.

An embodiment of the present invention provides a grid system for torsion spring mounting that has excellent stability and support.

An embodiment of the present invention provides a spacer bar in a grid system that is v-shaped for added torsional stability.

An embodiment of the present invention provides a spacer bar in a grid system which replaces the conventional standard cross tee.

An embodiment of the present invention provides a cruciform grid main in a grid system that has an alignment fin for accurate panel positioning.

An embodiment of the present invention provides a grid system having a spacer bar that can be moved laterally to avoid obstructions in the ceiling.

An embodiment of the present invention provides a grid system having panels that can easily be removed for access to items located above the ceiling.

An embodiment of the present invention provides a grid system for torsion spring mounting that is durable in construction, inexpensive to manufacture, easy to maintain, easy to assemble, and simple and effective in use.

An embodiment of the present invention provides a grid system for torsion spring mounting of aluminum-framed panels which includes a plurality of main grid beams and spacer bars. The main grid beams support a side load mounting clip formed with a slot in the side of the side load mounting clip to engage a torsion spring held by a spring retainer clip such that the panel is supported by the torsion spring. Disengagement of the torsion springs lowers the panels and permits access to the ceiling grid system above the panel members. The panel can have a multifaceted profile including an edge surface that abuts a corresponding edge surface on an adjacent panel. The peripheral edges of the adjacent panel members diverge above the abutting edge surfaces to accommodate either the alignment fin or the tab of the tile stop and diverge below the abutting edge surfaces to form a reveal.

The foregoing and other objects, features, and advantages of the invention will appear more fully hereinafter from a consideration of the detailed description that follows.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION AND PREFERRED EMBODIMENTS OF THE INVENTION

Figure 1:
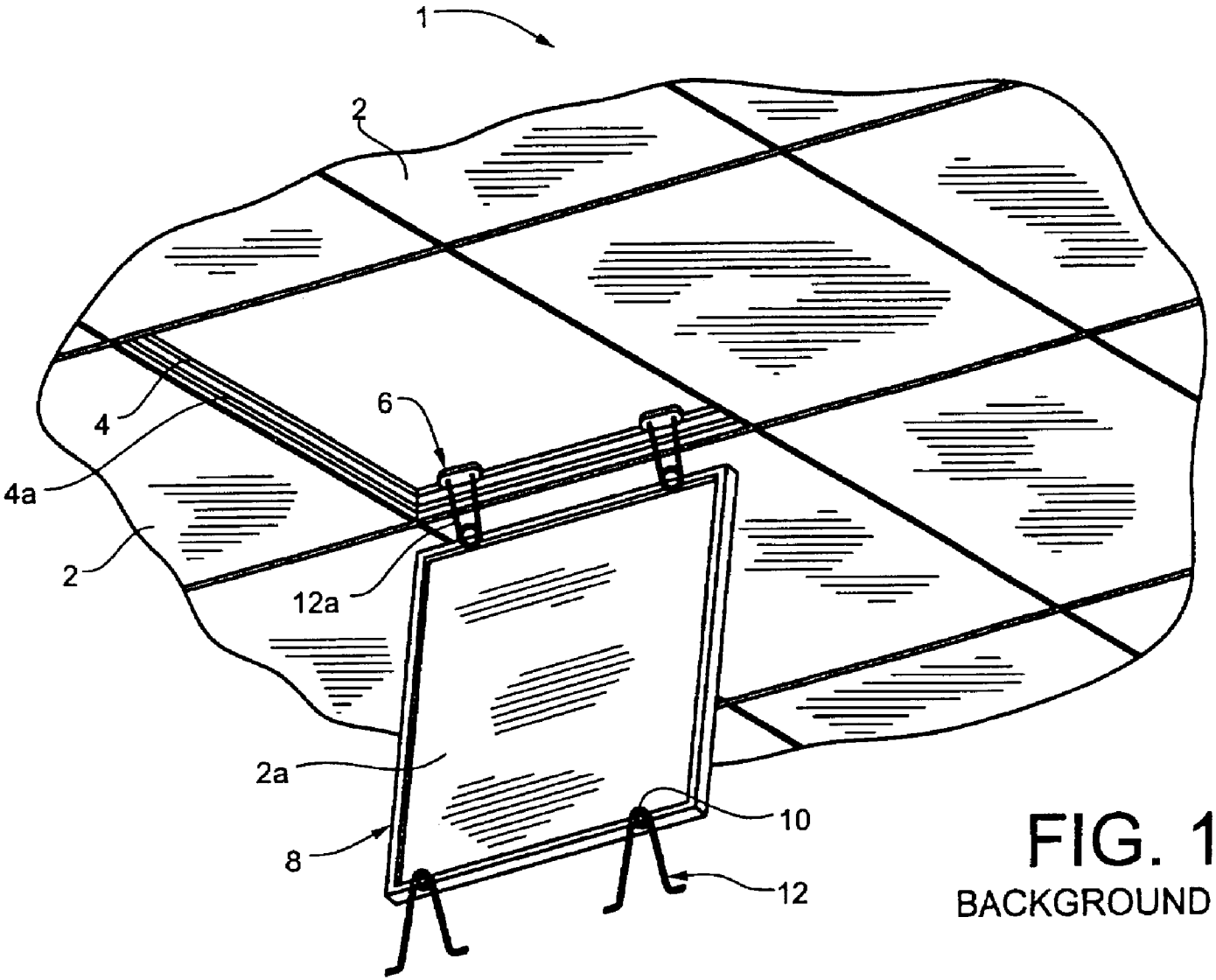
FIG. 1 BACKGROUND ART
FIG. 1 is a partial perspective drawing of a suspended ceiling system of the torsion spring type according to conventional torsion spring systems.
Figure 2:
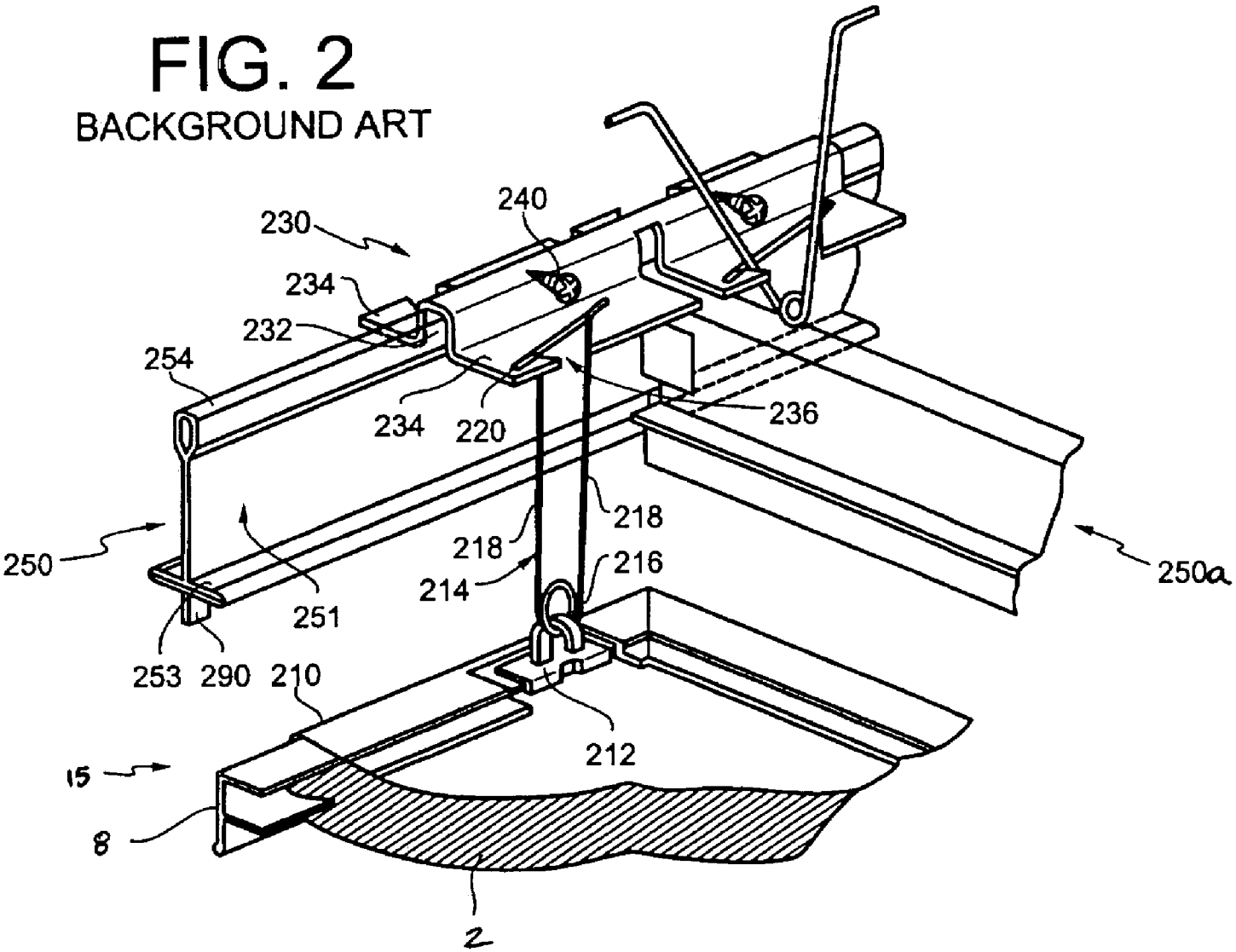
FIG. 2 BACKGROUND ART
FIG. 2 is a more detailed view of the torsion spring arrangement according to conventional torsion spring systems.
Figure 3:
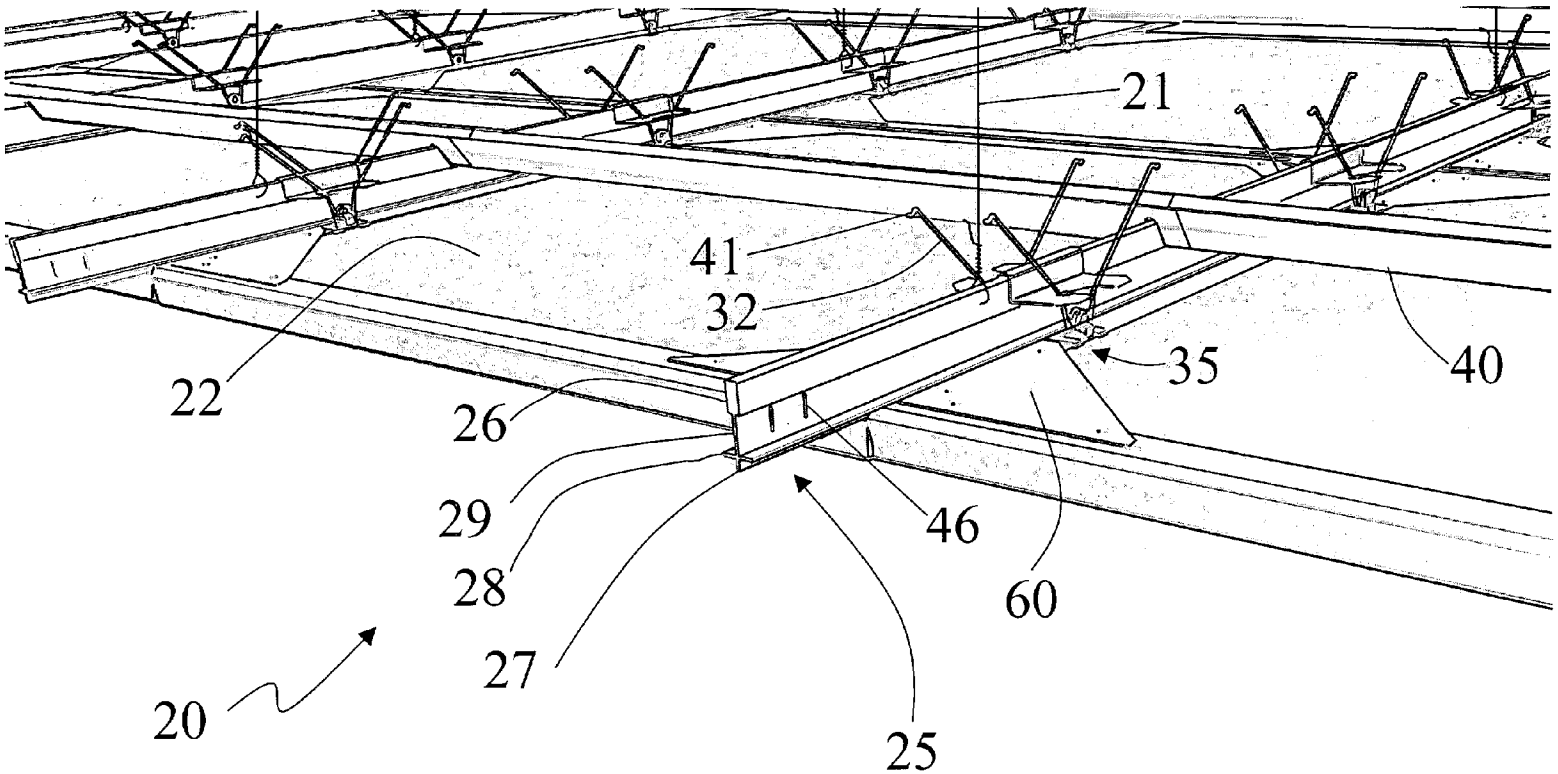
FIG. 3 is a partial perspective drawing of grid system for torsion spring mounting according to the principles of the present invention.

Referring now to FIGS. 3–10, the grid system for torsion spring mounting according to embodiments of the present invention can best be seen. In grid system 20, the cruciform grid mains 25 are hung from the ceiling from wires 21 in a conventional manner and connected end to end by a grid main connector (not shown). To attach the grid main connector (not shown) to the cruciform grid mains, tabs 24 of the grid main connector are inserted into corresponding slots 46 in the cruciform grid mains 25. The grid main connector is fastened to the cruciform grid mains 25 by bending the tabs 24 until they are flush with the cruciform main grid 25. Preferably, each connector has four tabs 24.

Each cruciform grid main 25 is formed of a bulb 26 attached to a web 29, a pair of arms 28 extending laterally from the web 29, and an alignment fin 27 extending from the web. The bulb 26 is formed of a large size, e.g., ⅝", which provides a large contact surface for the attachment of the side load grid mounting clip 33 and v-shaped spacer bars 40 described below. This large contact surface assists in making the grid system 20 sturdy and rigid. The alignment fin 27 provides accurate panel positioning by providing a straight edge and rounded tip to self align with the panel perimeter profile planer surface for the edges of the panels to abut and overcomes small lateral forces exerted by the springs that would otherwise cause a misalignment of the panels.

V-shaped spacer bars 40 sized to match the width of framed panels 22 are attached to the cruciform grid mains 25 by aligning a notch 42 cut near the end of the spacer bar 40 with the bulb 26 of the cruciform grid main 25. The depth of the notch 42 is preferably equivalent to the height of the bulb 26 to maximize the contact surface between the v-shaped spacer bar 40 and the bulb 26. The spacer bars 40 slightly overlap each other at the cruciform grid mains 25 to provide for added stability. This overlapping of the spacer bars 40 can be best seen in FIG. 8*b*. The spacer bars 40 are held in place by a friction fit. Because the spacer bars 40 are affixed without fasteners, the spacer bars 40 can be laterally adjusted to avoid obstructions in the ceiling, such as sprinklers.

A spring retainer clip 35 having a base portion 37 for attaching the spring retainer clip 35 to the framed panel 22 and a u-shaped hook member 36 for retaining a torsion spring 30 is attached to the metal frame 23 located around the circumferential edge of the panel 22 at each of the desired locations for the torsion springs 30. In particular, spring retainer clips 35 are attached to the frame member 23 of the panel 22 on opposing sides of the panel 22, most often on the longest dimension of the panel 22 such that the number of spring retainer clips 35 on each opposing side of the panel 22 is the same. In addition, the number of spring retainer clips 35, and thus torsion springs 30, located on any given panel 22 is preferably an even number. However, if panel cutouts dictated fewer or additional spring retainer clips 35, such changes could easily be addressed in either the factory or the field.

Figure 6:
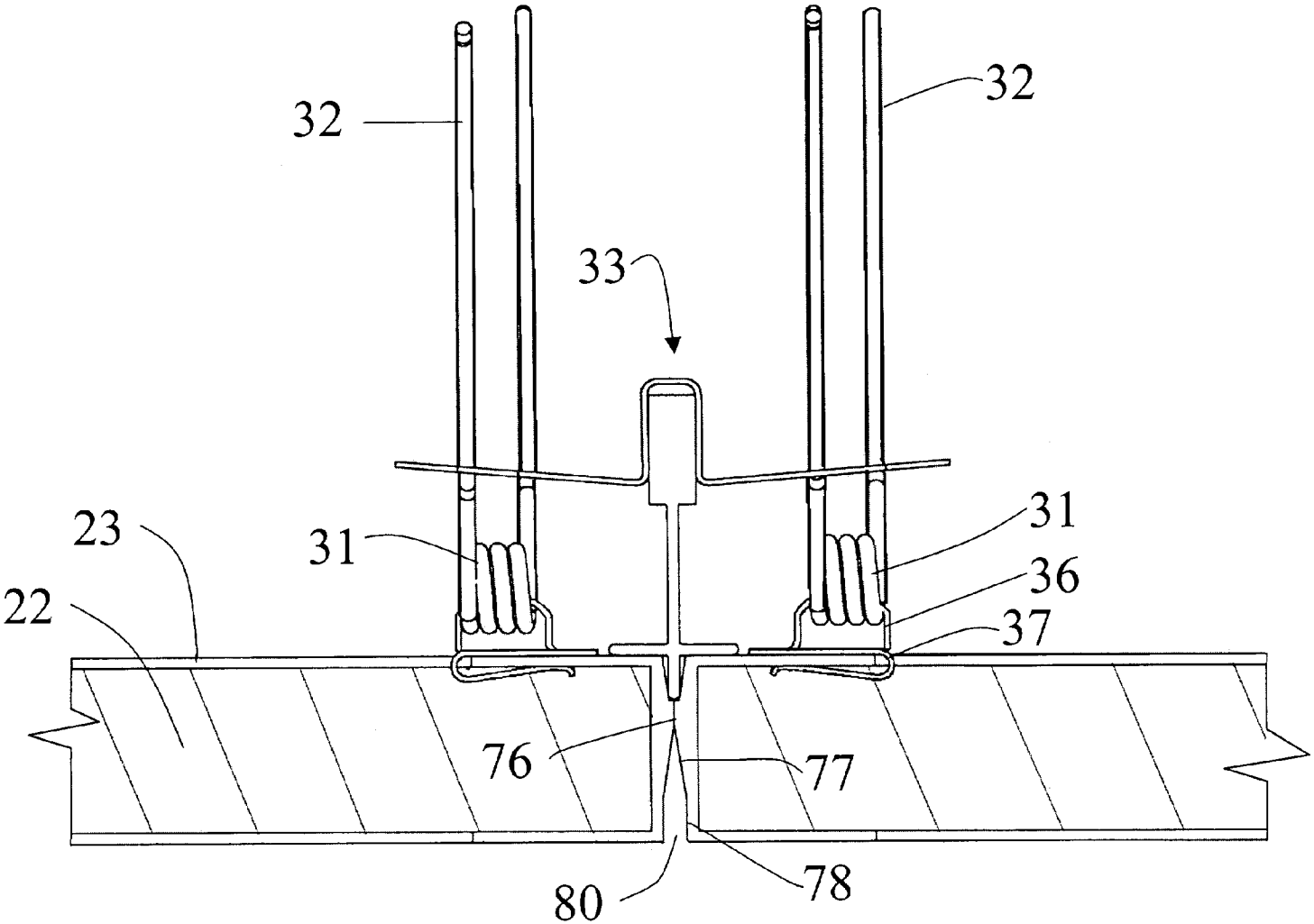
FIG. 6 is an elevational view of the spring retainer affixed to the panel.
Figure 7:
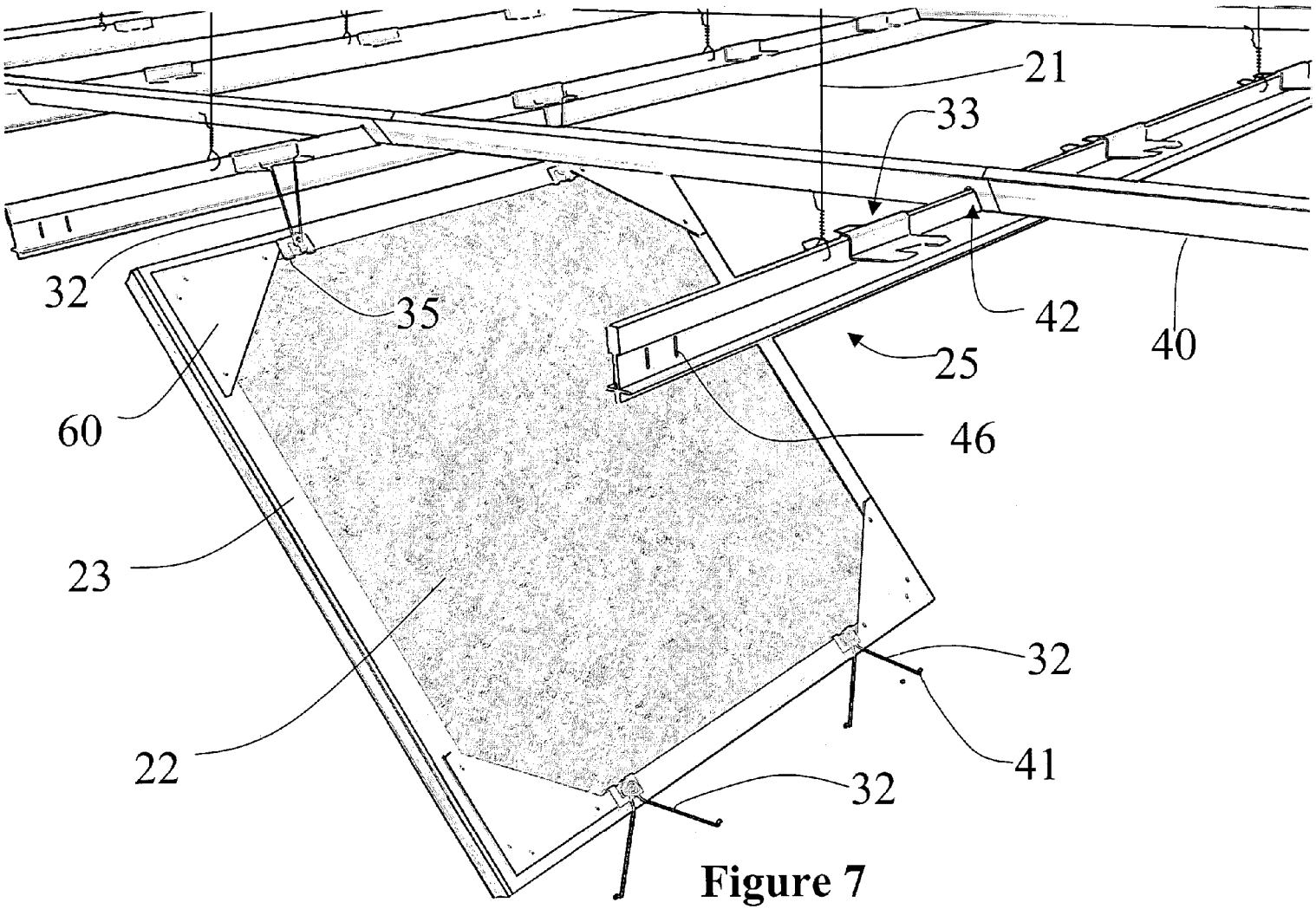
FIG. 7 is a perspective view of the grid system shown in FIG. 3 depicting the panel in an open configuration.

In order for the spring retainer clip 35 to be of a sufficient strength to hold the panel 22 in a substantially vertical position in the open configuration as described in detail below and illustrated in FIG. 7, the spring retainer clip 35 is heat treated such that the metal becomes spring steel. Further, as shown in FIG. 6, the u-shaped member 36 extends from the base 37 slightly off the center of the base portion 37 such that the spring is vertically positioned in the assembly. The attachment of the u-shaped member 36 is on the side towards the panel edge, which decreases the possibility of the u-shaped member 36 bending when the panel 22 is in the open configuration because the spring 30 moves closer to the base portion 37, thus shortening the lever arm. (See, e.g., FIG. 7). This unique location of the u-shaped portion 36 increases the strength of the spring retainer clip 35. In addition, the u-shaped member 36 must be properly dimensioned to fit the geometry of the system such that the spring maintains an upward force on the panel in the fully engaged position.

As seen in FIG. 6, the base portion 37 is attached to the frame 23 of the panel 22 by a pressure fit or by with teeth (not shown) that embed into the panel 22. Typically, the spring retainer clips 35 are attached to the framed panel 22 at the job site so that the spring retainer clips 35 can be adjusted to accommodate position changes. Typically, position changes of up to one foot can be accommodated by the spring retainer clip 35.

A torsion spring having a coil 31, arms 32, and retaining feet 41 is fitted onto the u-shaped hook member 36 of the spring retaining clip 35 such that the u-shaped hook member 36 projects through the coil 31 and the arms 32 extend away from the base portion 37. The torsion spring can be formed of music wire and typically has a spring release force of seven pounds to effect disengagement of the spring 20 from the side load grid clip. A bend 44 in the spring 30 is advantageously located to provide additional lifting force during full panel engagement, yet allowing the spring to be light enough to be easily compressed by hand for insertion into the flanges 38 of the side load mounting clips 33. This unique feature creates a strong point in the spring by maximizing the angular movement or rotation of the spring just at the point of engagement which maximizes the lifting force. Thus lifting or upward force is greater than it would be without the bend.

Side load mounting clips 33 are attached to the bulbs 26 of the cruciform grid main 25 and are held in place by a pressure fit. Each side load mounting clip 33 has a substantially u-shaped channel 34 that fits snugly over the cruciform grid main and flanges 38 extending outwardly from said u-shaped channel 34. The inside tolerances of the u-shaped channel 34 are such that they can be friction fit onto the bulb 26 of the cruciform grid main 25 yet can be repositioned, such as to avoid ceiling obstructions. Unlike the convention grid systems, a screw or other attachment device is not necessary because the friction force between the side load mounting clip 33 and the bulb 26 of the cruciform grid main 25 is greater than the friction force between the spring 30 and the side load mounting clip 33, primarily because the spring 30 has a very small contact surface.

Preferably, the side load mounting clips 33 are spaced six inches from panel ends such that a common interval between springs will be one foot on cruciform grid mains 25 to ease installation. Similar to the v-shaped spacer bars 40 and the spring retainer clips 35, the side load mounting clips 33 can be moved laterally on the cruciform grid mains 25 to accommodate small position changes and/or to align with the spring retainer clip 35. Unlike conventional systems in which the springs are attached from below, the side loading of the torsion springs 30 simplifies installation.

Unlike conventional grid systems, both the side load mounting clip 33 and the spring retainer clip 35 can be laterally positioned along the grid mains, thereby permitting custom positioning of springs to avoid ceiling interferences and ultimately positioning the finished ceiling closer to the surface above. In larger panels, additional sets of springs 30, spring retainer clips 35, and side load mounting clip 33 are located at various points along the panel edge for additional support.

Figure 4:
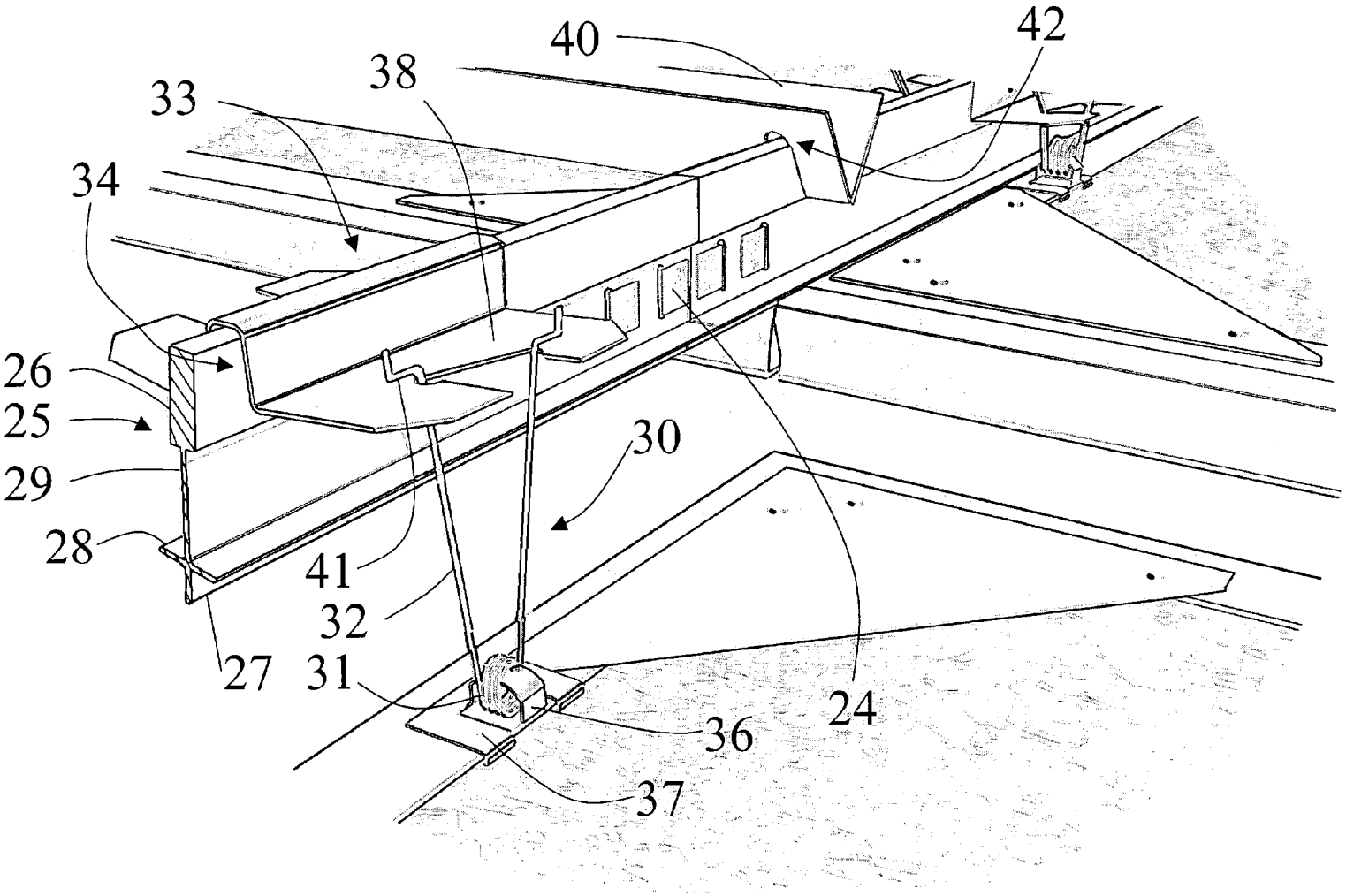
FIG. 4 is an enlarged partial perspective drawing of the grid system shown in FIG. 3.
Figure 5:
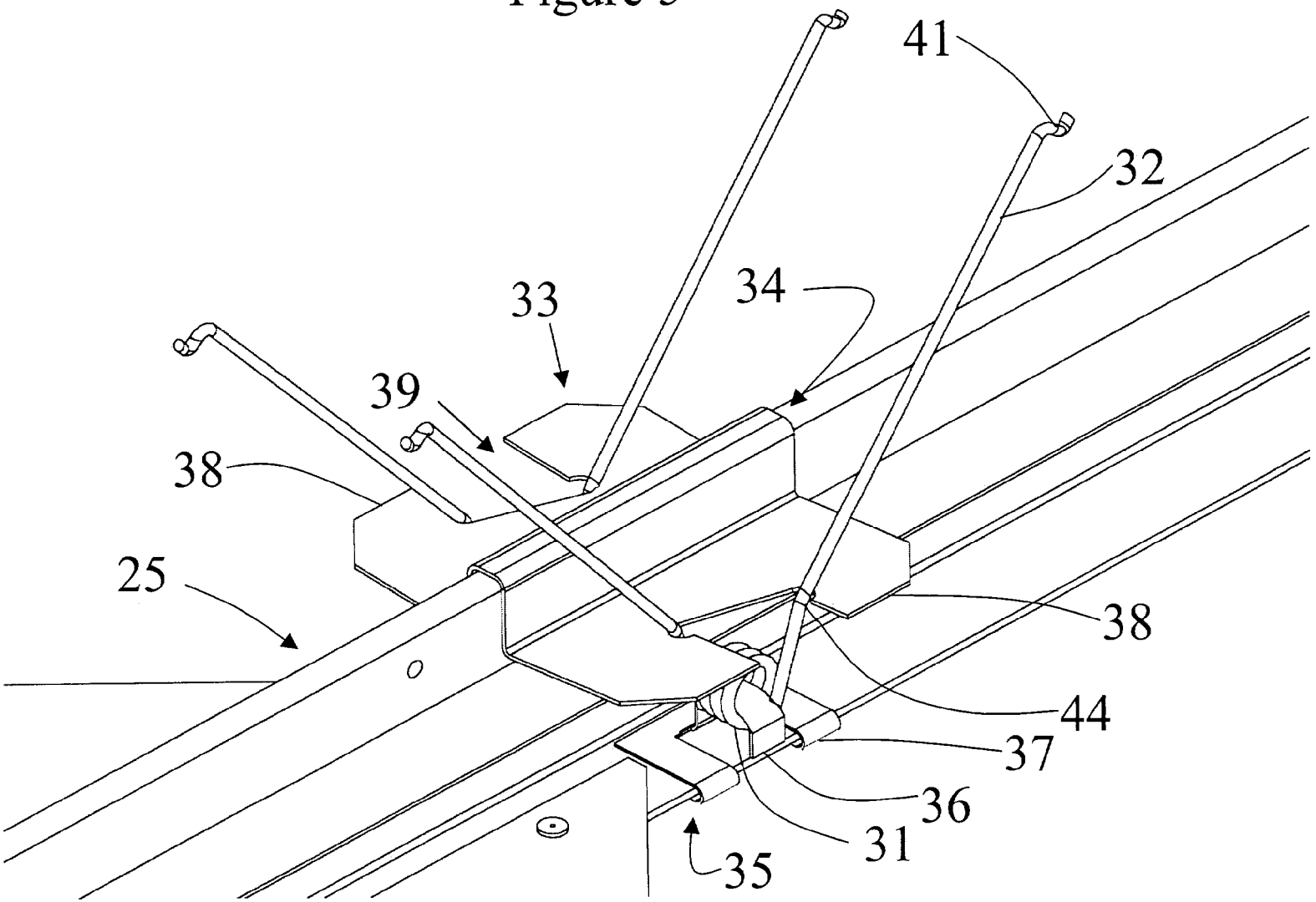
FIG. 5 is an enlarged perspective view of the side load grip clip engaged with the torsion spring in an engaged position.

As seen in FIGS. 4–5, arms 32 of the torsion spring 30 fit into the ends of the slot 39 such that the arms project outwardly and pull the spring retainer clip 35, and thus the framed panel 22, towards the arms 28 of the cruciform main grid 25 when the torsion spring 30 is in the engaged position. When each the springs 30 located on one panel 22 is engaged with the spring retainer clip 35, the panel is in the closed configuration.

The panel 22 can have triangular gussets 60 located in the corners of the panel 22 and connected, e.g., riveted or screwed, to the panel frame 23 for additional stability. The gusset ends are cut square for safety reasons and to provide a guide for the placement of the spring retainer clip 35. The triangular design of the gusset 60 at each corner of the panels 22 allows for expedited panel assembly and assures a tight squareness tolerances of ±1/32 of an inch. In addition, the gusset 60 placed on an aluminum frame panel is highly resistant to racking forces frequently encountered during assembly and installation. The stability of the gusset 60 is based on mechanical fasteners. Holes are predrilled in the frame 23 and gussets 60 are cut to a predetermined angle, e.g., 90 degrees, to allow for quick alignment and fastening. Changes in panel angles can be easily made by cutting the gusset at a different angle. The panels 22 can be optionally wrapped in a fabric (not shown). Alternatively, the panels 22 can be formed of materials other than fiberglass, such as metal, mesh, or wood.

Figure 8B:
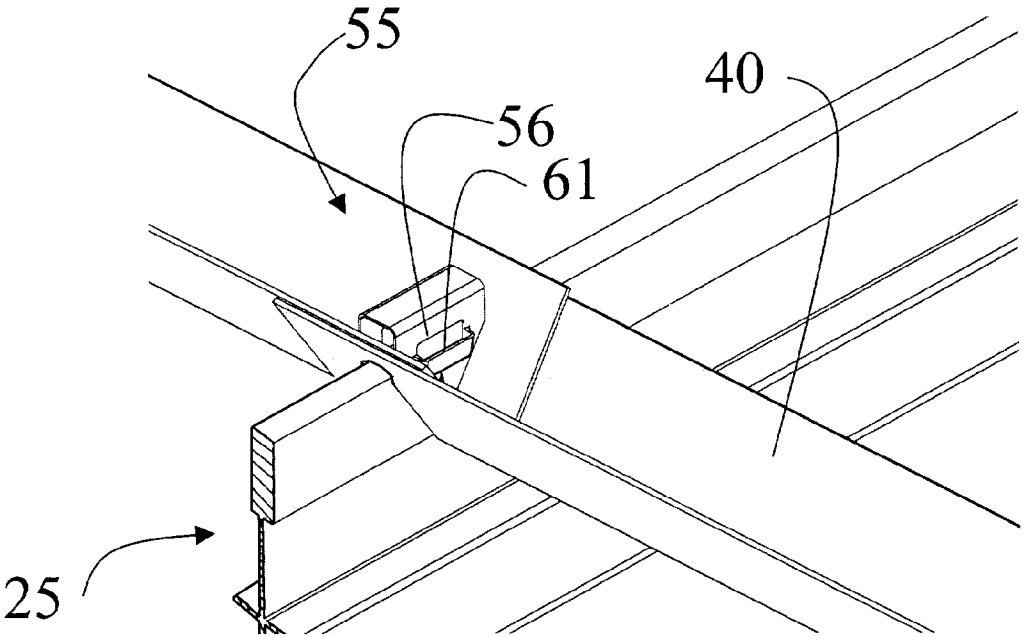
FIG. 8*b* is an perspective view of the v-clip affixed to the cruciform grid main.
Figure 8A:
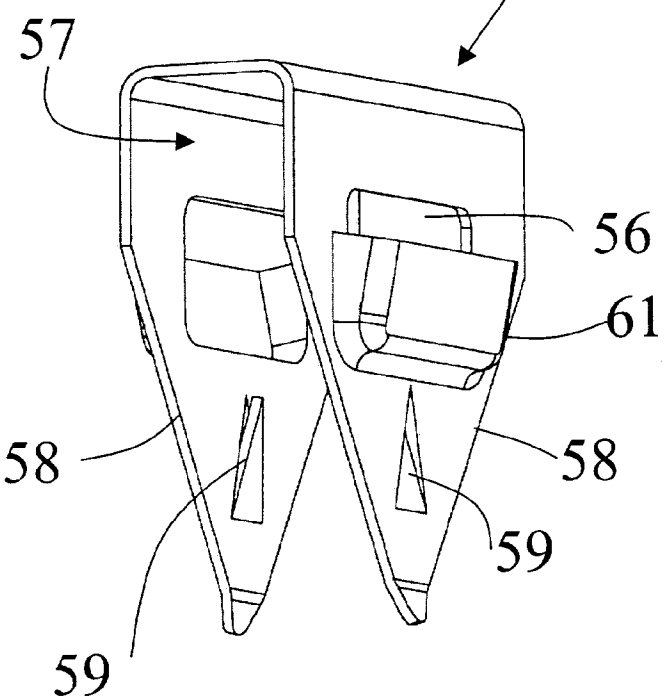
FIG. 8*a* is a perspective view of the v-clip.

Referring now to FIGS. 8*a* and 8*b*, in an alternative embodiment of the present invention, v-clips 55 are affixed to the bulb 26 of the cruciform grid main 25 between the "v" of the v-shaped spacer bars 40 to ensure that the v-shaped spacer bars 40 do not disengage from the cruciform grid mains 25. The v-clips include a u-shaped channel portion 57 that fits over the bulb 26 and v-shaped sidewalls 58 extending from the u-shaped channel portion 57 that are sized to fit into the v-shaped spacer bars 40. Teeth 59 tightly grip the v-clip to the bulb 26. A removal slot 56 in the sidewalls 58 permit the insertion of a flat object, e.g., screwdriver blade, to pry the v-clip 55 from the surface of the bulb 26 by pressing against a lever member 61. The v-clip 55 can be formed of a zinc plated spring steel. V-clips are typically used in curved ceilings or in ceilings that require a specific seismic rating.

Figure 9B:
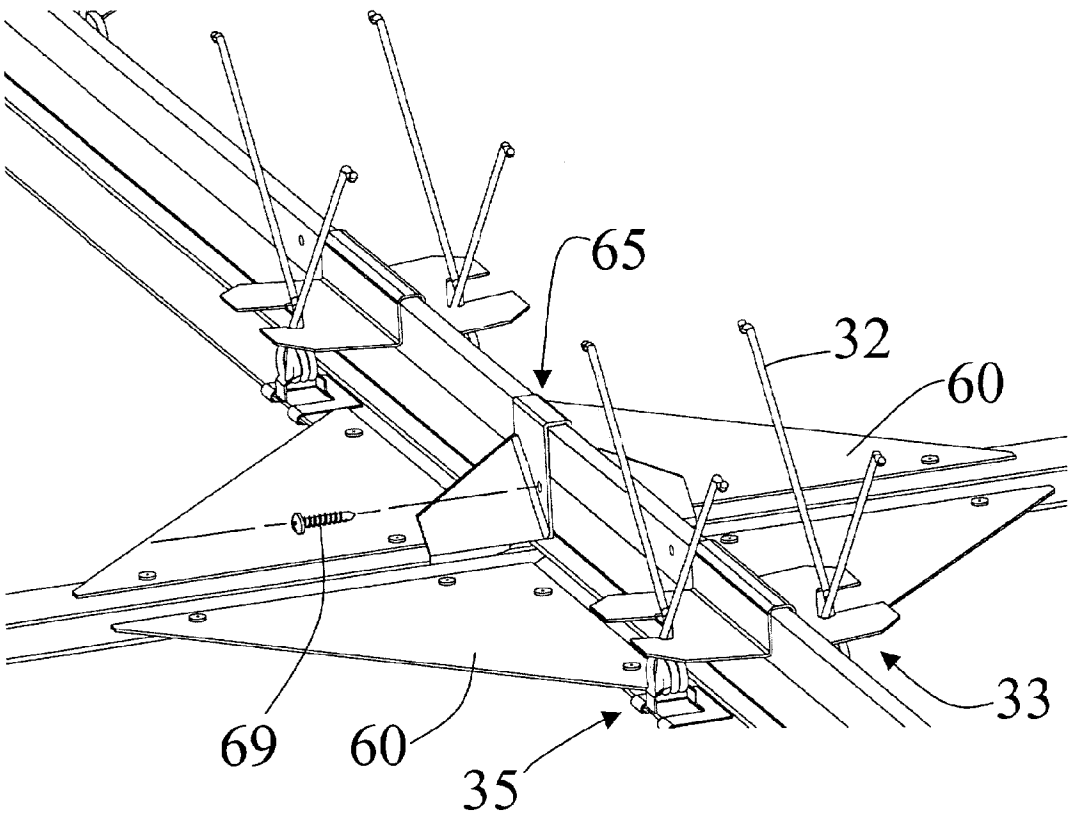
FIG. 9*b* is a perspective view of a grid system according to the principles of the present invention depicting the attachment of the tile stop to the cruciform grid main.
Figure 9A:
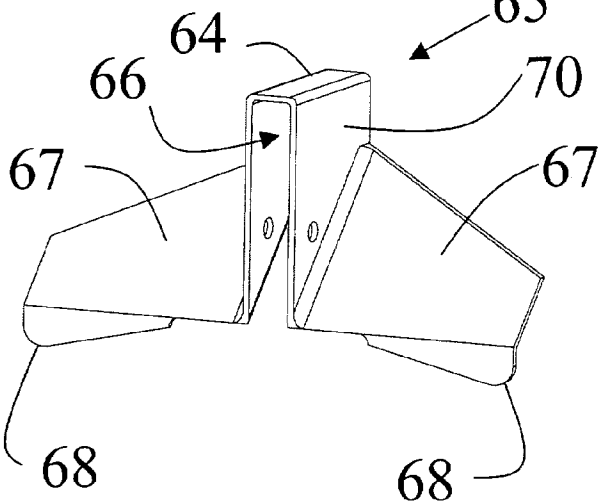
FIG. 9*a* is a perspective view of the tile stop.

In a the embodiment illustrated in FIGS. 9*a* and 9*b*, tile stops 65 are affixed to the cruciform grid mains 25 by a releasable fastener 69 (e.g., a screw) at the intersection point of the panels 22. The tile stops 65 are formed of a channel 66 shaped to fit over the bulb 26 of the cruciform grid main 25. The channel 66 includes a base portion 64 defining a first axis and a pair of sidewalls 70 extending from the base portion 64. Downwardly depending flanges 67 extend outwardly from the sidewalls 70 at an angle relative to the first axis. Tabs 68 on the flanges are inserted into the space between the panels 22 to align the panels along the length of the grid system 20 and to position any non-horizontal panels so that they are in proper alignment. In particular, a row of tile stops 65 across successive cruciform grid mains 25 force alignment in a lateral direction. Tile stops 65 are preferably used in curved ceiling to prevent gravity from pulling the panels 22 out of alignment.

Figure 10:
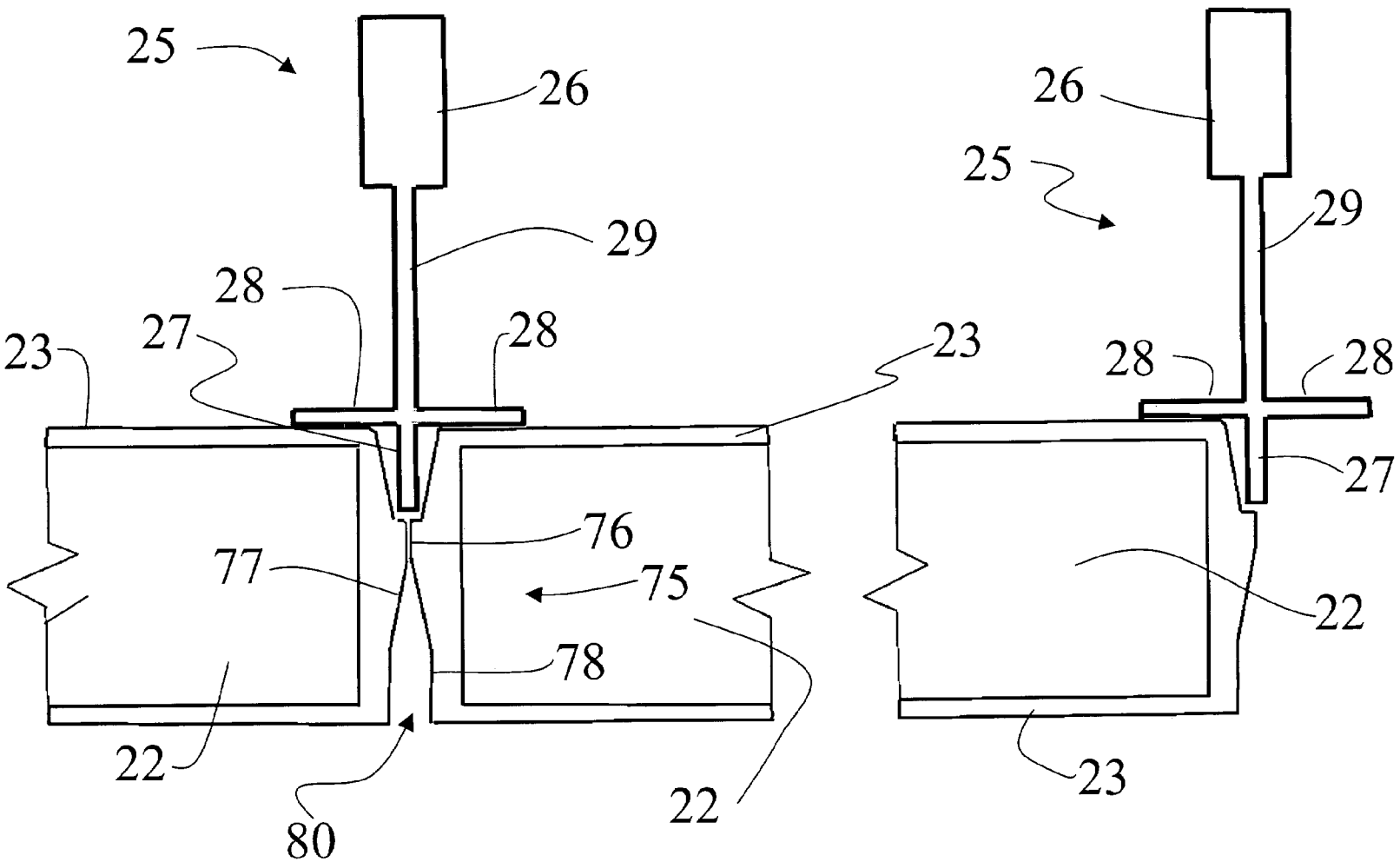
FIG. 10 is an elevational view of the profile of the ceiling panels in a preferred embodiment of the present invention.

In another embodiment, the profile of the frame (i.e., the peripheral edge of the frame) can have a multifaceted surface as illustrated in FIG. 10. As shown in FIG. 10, the profile 75 is shaped to form an edge surface 76 that abuts a corresponding edge surface on an adjacent panel. The peripheral edges of the adjacent panel members diverge above the abutting edge surfaces to accommodate either the alignment fin 27 of the grid cruciform grid main 25 or the tab 68 of the tile stop 65. The peripheral edges of the adjacent panel members diverge below the abutting edge surface 76 to form a reveal 80. Preferably, the peripheral edges below abutting edge surface 76 are formed of a diverging portion 77 and a vertical portion 78 that forms a reveal (e.g., ⅛"). The diverging slight slant profile is a self-alignment feature. Because of this self-alignment feature and the fact that the panel to panel contact is sufficiently large, the panels do not shift and will rest flush with the adjacent panels. Further, the angled profile centers the panels within the grid to provide a better overall alignment between the panel and the grid. In addition, the alignment fin 27 of the cruciform grid main 25 is hidden by the profile, thereby enabling the grid system 20 to be used in either a spring ceiling system or in a direct mount "z" clip system in which no grid above the panel 22 is needed.

The panel frame 23 is typically formed as a "c"-channel in which the panel frame 23 is shaped like a "c". The c-channel provides a good capture profile to secure core fiberglass or other optional materials within it. By adhering a surface molded fiberglass face mat to the perimeter leg of the channel, a stiffer surface skin results which reduces potential fiberglass board sag in the middle of the panel.

To access pipes, wires, or any other item of interest above the panels 22, the panel 22 is pulled downward so that all springs 30 are in the lowered position. When the springs 30 on one side of the panel 22 are disengaged from the spring retaining clip 35, the panel is located in a substantially vertical position as is illustrated in FIG. 7. The springs 30 located at the opposing end of the panel 22 are pulled away from the spring retainer clips 35 by the weight of the panel until the retaining feet 41 rest against the flanges 38. When the springs 30 on one side of the panel 22 are disengaged and the panel is substantially vertical with respect to the cruciform grid main 25, the panel 22 is in the open configuration.

In another embodiment, the edge of the panel 22 is pulled downward with a panel removing tool (not shown). The panel removing tool (not shown) can have a variety of shapes and sizes as would be identified by one of skill in the art, but preferably is in the shape of a "T" or "L". In operation, the tool is inserted into a pre-formed hole (not shown) located at the edge of the panel 22 between the location of the springs 30. The panel removing tool is then inserted into the hole where it engages with the panel 22. Pulling downward on the panel removing tool pulls the edge of the panel 22 and, if enough force is applied, will disengage the torsion springs 22, thereby placing the panel 22 in an open configuration. Optionally, a hole (not shown) is placed in the side of the profile (not shown), e.g., in vertical portion 78 within the reveal 80, to permit the insertion of a small hook so that the panel 22 can be pulled down and placed into an open configuration.

To place the panel 22 back into the closed configuration, the disengaged torsion springs 30 are placed into the u-shaped channel 36 spring retainer clip 35 so that the retaining feet 41 of the torsion springs 30 are resting against the flanges 38 of the side load mounting clip 33. Once all springs on the panel 22 are engaged with the u-shaped channel 36 of the spring retainer clip 35, the panel 22 is in a substantially horizontal position beneath the grid system 20. One end of the panel 22 is then simply pushed upward towards the ceiling until the torsion springs 30 located on that end of the panel 22 are fully engaged with the side load mounting clip 33. Next, the opposing end of the panel 22 is pushed upward until the torsion springs 30 located at that end of the panel 22 are fully engaged with the side load mounting clip 33.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A ceiling grid system comprising:

a plurality of main grid beams oriented in a parallel configuration, each said main grid beam being formed with a bulb at a top portion thereof;

a plurality of spacer bars interconnecting said main grid beams in a general perpendicular orientation to maintain a regular spacing between selected said main grid beams, said spacer bars being configured to permit a friction fit with said bulbs on said main grid beams; and a spring mechanism for connection to selectively movable panel members that fit between said main grid beams enabling each of said panel members to be selectively lowered to permit access to said ceiling grid system, said spring mechanism being supported by one of said main grid beams and including a side load mounting clip formed with a central arch configured to permit a friction fit with said bulb on said one main grid beam such that said side load mounting clip can be positioned at a desired location along the length of the corresponding said main grid beam to accommodate obstructions to a regular positioning of said side load mounting clips, wherein each said spring mechanism further includes a torsion spring member engageable with said side load mounting clip, said torsion spring member being connected to a spring retainer clip adapted to be detachably connected to one of said panel members such that said panel member is supported by said torsion spring member, wherein said side load mounting clip is formed with a flange extending generally orthogonally on each opposing side of said central arch configured to engage said bulb, each of said flanges being formed with a slot for support of one of said torsion spring members, wherein said side load mounting clip is devoid of any fasteners connecting said side load mounting clip to said main grid beam.

2. The ceiling grid system of claim 1, wherein said perpendicular spacer bars are v-shaped spacer members formed with a notch to permit said friction fit with said bulb on said main grid beams, said v-shaped spacer members being movable relative to said main grid beams to avoid obstructions to a regular positioning of said v-shaped spacer members.

3. The ceiling grid system of claim 2, wherein said spacer members overlap each other at said main grid beams to provide stability to said ceiling grid system.

4. The ceiling grid system of claim 2, wherein said v-shaped spacer members are devoid of any fasteners connecting said v-shaped spacer members to said main grid beam.

5. The ceiling grid system of claim 4, wherein said v-shaped spacer members include a pair of arms meeting at an apex having a shaped slot formed therein, said slot being configured to engage said bulb on said main grid beam.

6. The ceiling grid system of claim 5, further comprising a clip formed from spring steel that is engageable with said bulb on said main grid beams between said arms of said v-shaped spacer members such that the removal of said spacer members from said main grid beams requires disengagement of said clip from said main grid beam.

7. The ceiling grid system of claim 6, wherein said clip is formed with opposing arms and a channel portion configured to engage said bulb, each said opposing arm of said channel portion having a tooth to fit beneath said bulb.

8. The ceiling grid system of claim 7, wherein said clip further includes a removal slot formed in each said opposing arm to permit the intrusion of a flat object between said clip and said main grid beam to pry said clip off of said bulb.

9. The ceiling grid system of claim 8, wherein said clip is triangularly shaped to fit within the confines of said v-shaped spacer member.

10. A ceiling grid system comprising:

a plurality of main grid beams oriented in a parallel configuration, each said grid beam being formed with a bulb at a top portion thereof;

a plurality of spacer bars interconnecting said main grid beams in a generally perpendicular orientation to maintain a regular spacing between selected said main grid beams;

panel members arranged to fit between said main grid beams, said panel members being connected to said spring members to be selectively movable relative to said main grid beams to permit each of said panel members to be selectively lowered to permit access to said ceiling grid system above said panel members;

a side load mounting clip formed with a central arch configured to permit a friction fit with said bulb on said main grid beams such that said side load mounting clip can be positioned at a desired location along the length of the corresponding said main grid beam to accommodate obstructions to a regular positioning of said side load mounting clips, said side load mounting clip being devoid of any fasteners connecting said side load mounting clip to said main grid beam;

spring members supported on said side load mounting clips to be generally vertically movable relative thereto, wherein each said spring member is formed as a torsion spring member engageable with said side load mounting clip to engage with a spring retainer clip detachably connected with one of said panel members such that said panel member is supported by said torsion spring member, wherein said side load mounting clip is formed with a flange extending generally orthogonally on each opposing side of said central arch configured to engage said bulb, each of said flanges being formed with a slot for support of one of said torsion spring members.

11. A ceiling grid system comprising:

a plurality of main grid beams oriented in a parallel configuration, each said grid beam being formed with a bulb at a top portion thereof;

perpendicular spacer bars interconnecting said main grid beams to maintain regular spacing between selected said main grid beams, said spacer bars being formed as a v-shaped member defining a pair of arms meeting at an apex having a shaped slot formed therein, said slot being configured to engage said bulb on said main grid beam, said spacer bar being connectable to said main grid beam through a friction fit between said bulb and said shaped slot;

a spring mechanism connected to selectively movable panel members that fit between said main grid beams enabling each of said panel members to be selectively lowered via said spring mechanism so as to allow access to said ceiling grid system above said panel members;

a clip formed from spring steel that is engageable with said bulb on said main grid beams between said arms of said v-shaped spacer bar such that the removal of said spacer bar from said main grid beam requires the disengagement of said clip from said main grid beam wherein said clip is formed with a channel portion configured to engage said bulb and a tooth on each opposing arm of said channel portion to fit beneath said bulb.

12. The ceiling grid system of claim 11, wherein said clip further includes a removal slot formed in each said opposing arm to permit the intrusion of a flat object between said clip and said main grid beam to pry said clip off of said bulb.

13. The ceiling grid system of claim 12, wherein said clip is triangularly shaped to fit within the confines of said v-shaped spacer bar.

14. The ceiling grid system of claim 13, wherein said clip is formed from zinc plated spring steel.

15. A ceiling grid system comprising:

a plurality of main grid beams oriented in a parallel configuration, each said main grid beam being formed with a bulb at a top portion thereof;

perpendicular spacer bars interconnecting said main grid beams to maintain a regular spacing between selected said main grid beams;

a spring mechanism connected to selectively movable panel members arranged to fit between said main grid beams permitting each of said panel members to be selectively lowered to permit access to said ceiling grid system above said panel members; and a tile stop formed with a central channel portion to engage said bulb on one of said main grid beams and being positionable anywhere along said main grid beams, said tile stop further having a downwardly depending tab located on a downwardly depending flange that is adapted to be positioned between adjacent said panel members to maintain proper positioning of said adjacent panel members when said panel members are in a closed configuration.

16. The ceiling grid system of claim 15, wherein said tile stop is formed with a downwardly depending flange on opposing sides of said central channel such that respective tabs on the respective said flanges are engageable with separate adjacent pairs of said panel members.

17. The ceiling grid system of claim 16, wherein said tile stop is secured to said main grid beam with a fastener.

18. The ceiling grid system of claim 16, wherein each said panel member is formed with a peripheral edge extending around said panel member, said peripheral edge having an edge surface that abuts a corresponding edge surface on an adjacent said panel member, said peripheral edges of said adjacent panel members diverging above said abutting edge surfaces to accommodate said flange of said tile stop.

19. The veiling grid system of claim 18, wherein said peripheral edges of said adjacent panel members diverge below said abutting edge surfaces to form a reveal.

20. The ceiling grid system of claim 18, wherein said peripheral edge of said panel member is a metal frame.

21. The ceiling grid system of claim 18, wherein said tile stop further includes a base portion in which said central channel is formed and a pair of opposing side walls integrally formed with said base portion said flanges extending downwardly from the respective side walls to position said tabs between adjacent said panel members.

22. A ceiling grid system comprising:

a plurality of main grid beams oriented in a parallel configuration, each said grid beam being formed with a bulb at a top portion thereof;

a plurality of spacer bars interconnecting said main grid beams in a general perpendicular orientation to maintain a regular spacing between selected said main grid beams;

panel members formed with a peripheral edge extending around said panel members, said peripheral edge being shaped to provide an edge surface that abuts a corresponding said edge surface on an adjacent said panel member, said peripheral edges of said adjacent panel members diverging above said abutting edge surfaces; wherein gussets are connected to said panel members for added stability; and a spring mechanism for connection to each of said panel members, said spring mechanism permitting each of said panel members to be selectively lowered relative to said main grid beams to permit access to said ceiling grid system above said panel members, wherein each said spring mechanism further includes a torsion spring member engaging side load mounting clip, said torsion spring member being connected to a spring retainer clip detachably connected to one of said panel members such that said panel member is supported by said torsion spring member, wherein said side load mounting clip is formed with a flange extending generally orthogonally on each opposing side of a central arch configured to engage said bulb, each of said flanges being formed with a slot for support of one of said torsion spring members, wherein said side load mounting clip is devoid of any fasteners connecting said side load mounting clip to said main grid beam.

23. The ceiling grid system of claim 22, wherein said peripheral edges of said adjacent panel members diverge below said abutting edge surfaces to form a reveal.

24. The ceiling grid system of claim 22, wherein said peripheral edge is a metal frame.

25. The ceiling grid system of claim 24, wherein said metal frame provides support and stiffness to said ceiling grid system.

26. The ceiling grid system of claim 22, wherein said gussets are triangularly shaped with pre-drilled holes for easy assembly.

27. The ceiling grid system of claim 26, wherein said gussets provide a guide for placement of a spring retainer clip detachably connected to one of said panels.

28. The ceiling grid system of claim 27, wherein the diverging portion below said abutting edge surfaces self-aligns said panel members with respect to said main grid beams.

29. The ceiling grid system of claim 28, further comprising a hole in said peripheral edge to permit insertion of a tool to lower said panel members.

* * * * *